US006342693B1

(12) United States Patent
Smith et al.

(10) Patent No.: US 6,342,693 B1
(45) **Date of Patent: *Jan. 29, 2002**

(54) RESIZABLE MICROWAVE OVEN LINER APPARATUS AND METHOD

(76) Inventors: Rose Mary Smith, 39 N. Grand St.; Elizabeth Hogan; David Hogan, both of 87 N. Grand St., all of Cobleskill, NY (US) 12043

( * ) Notice: Subject to any disclaimer, the term of this patent is extended or adjusted under 35 U.S.C. 154(b) by 0 days.

This patent is subject to a terminal disclaimer.

(21) Appl. No.: 09/632,274

(22) Filed: Aug. 3, 2000

Related U.S. Application Data

(63) Continuation-in-part of application No. 09/374,358, filed on Aug. 13, 1999, now Pat. No. 6,137,097.

(51) Int. Cl.[7] ..... H05B 6/80

(52) U.S. Cl. ..... 219/756; 219/725; 219/392; 99/DIG. 14; 126/39 M

(58) Field of Search ..... 219/725, 756, 219/391, 392, 395; 126/39 M; 99/DIG. 14, 451

(56) References Cited

U.S. PATENT DOCUMENTS

| | | | | |
|---|---|---|---|---|
| 4,190,757 | A | 2/1980 | Turpin et al. | |
| 4,563,559 | A | 1/1986 | Enami | |
| 4,633,052 | A | 12/1986 | Beavers et al. | |
| 4,714,013 | A | 12/1987 | Telfer | |
| 4,721,140 | A | 1/1988 | Coker | |
| 4,778,968 | A | 10/1988 | Torres | |
| 4,785,106 | A | 11/1988 | Hart | |
| 4,797,523 | A | 1/1989 | Kohnen | |
| 4,801,773 | A | 1/1989 | Hanlon | |
| 4,937,410 | A | 6/1990 | Anderson | |
| 4,950,859 | A | 8/1990 | Anderson | |
| 4,965,424 | A | 10/1990 | Bagley | |
| 5,026,957 | A | 6/1991 | Pralus | |
| 5,026,958 | A | 6/1991 | Palacios | |
| 5,235,149 | A | 8/1993 | Boehrer | |
| 5,290,985 | A | 3/1994 | Janic et al. | |
| RE34,829 | E | 1/1995 | Stone | |
| 5,436,434 | A | 7/1995 | Baird | |
| 5,770,840 | A | 6/1998 | Lorence | |
| 5,814,382 | A | 9/1998 | Yannuxxi, Jr. | |
| 5,834,046 | A | 11/1998 | Turpin et al. | |
| 5,927,266 | A | 7/1999 | Maugard | |
| 6,137,097 | A | * 10/2000 | Smith et al. | 219/725 |

FOREIGN PATENT DOCUMENTS

| | | |
|---|---|---|
| DE | 41 02 052 A | 8/1992 |
| GB | 1158792 | 7/1969 |

* cited by examiner

*Primary Examiner*—Philip H. Leung
(74) *Attorney, Agent, or Firm*—Jay R. Yablon

(57) ABSTRACT

A pleated microwave oven liner comprising a plurality of liner pleats, is expandable in the preferred embodiment from initial dimensions of approximately 6 inches in height by 11 inches in width, to final dimensions as large as approximately 15 inches in height by 21 inches in width, by ⅛ inch increments. This microwave oven liner, by virtue of its resizability (scalability), can be used to protect a wide range of sizes of microwave oven from spills and spatters associated with the microwave cooking and heating process.

52 Claims, 8 Drawing Sheets

RESIZABLE MICROWAVE OVEN LINER APPARATUS AND METHOD

CROSS-REFERENCE TO RELATED APPLICATIONS

This application is a continuation-in-part of application Ser. No. 09/374,358, filed Aug. 13, 1999, Pat. No. 6,137,097.

FIELD OF THE INVENTION

This invention relates generally to the fields of protective coverings, and specifically, to protecting a microwave oven from food spills and spatter.

BACKGROUND OF THE INVENTION

Microwave ovens are widely used all over the world to heat and cook food items much more rapidly than conventional heating ovens. But the nature of microwave technology is such that in the process of heating food items, the microwaves will often cause the food items to overflow, or to "pop," which of course, produces a mess along the sides, back and front (interior surface) of the microwave oven that needs to be cleaned with a sponge or similar cleaning apparatus. This entails reaching into the oven and applying "elbow grease" at various awkward angles, and as anyone who uses and has ever had to clean a microwave oven is aware, is tiresome and difficult.

The U.S. Patent literature does disclose some efforts to solve this problem. U.S. Pat. Nos. 4,721,140; 4,785,160; 4,797,523; 4,801,773; and 4,950,859, for example, all disclose various containers, covers, shields, etc., that are placed over or around a particular food item being cooked, in order to block and prevent spills and spatters from that food item from reaching the inner surface of the microwave oven. But these are associated in their use with each individual food item being cooked, rather than with the microwave oven itself. As such, these devices are removed along with the associated food item each time a food item is heated or cooked, and reintroduced into the microwave oven each time a new food is to be cooked.

U.S. Pat. Nos. 4,663,052; 4,778,968; and 5,290,985 improve this situation, since these protective devices are each used in connection with the microwave oven itself, and remain in place to guard against spills and spatter from the cooking of one food item to the cooking of subsequent foods items. After a time, once the protective device has become soiled beyond a certain point, the device is removed and disposed of, and is replaced with a new, similar device.

But microwave ovens are manufactured and sold in many varied sizes, and all of U.S. Pat. Nos. 4,663,052; 4,778,968; and 5,290,985 suffer the common deficiency that they cannot easily be used in connection with varying sizes of microwave oven. Indeed, a survey taken by applicants of over 100 microwave oven models reveals that microwave ovens typically vary in volume from about 0.5 to 1.8 cubic feet, and in linear dimension from a minimum height of about 6 inches to a maximum height of about 15 inches, from a minimum width of about 11 inches to a maximum width of about 21 inches, and from a minimum depth of about 10 inches to a maximum depth of about 18 inches. This survey also reveals that these linear dimensions typically vary by ¼ inch, ⅛ inch, ⅙ inch, or 1/16 inch increments. Given this wide size variability from one microwave oven to the next, it would be difficult or impossible to use the protective devices of U.S. Pat. Nos. 4,663,052; 4,778,968; and 5,290,985 for more than a single size of microwave oven, give or take perhaps a fraction of an inch along any one linear dimension. As such, if these protective devices were to be used for all commonly-manufactured oven sizes, it would be necessary to manufacture dozens of different sizes of these protective devices.

In addition, all of these liners are difficult to set up and attach for use inside the microwave oven, and (e.g., U.S. Pat. Nos. 4,778,968, column 2, lines 58–61) even need an independent support structure.

These liners also do not appear to provide suitable protection for the front door of a microwave oven.

Additionally, the choice of materials used to construct a microwave oven liner is very important. Saran-type polymeric materials do not hold up well over time and are meant for one use and then disposed of. They do not have a heat history at all, melting in the presence of steam resulting from cooking food. Cardboard-type material and papers commonly used in paper bag construction are not appropriate either. These materials absorb moisture and spilled foods. This causes them to stick to the microwave interior, defeating their purpose and usefulness.

OBJECTS OF THE INVENTION

It would be desirable therefor, to provide a microwave oven liner which can be configured (resized or scaled) to protect a wide range of microwave oven sizes, encompassing at least the size ranges noted in the background of the invention.

It would further be desirable if this resizing could be achieved at various small increments, permitting the microwave oven liner to be resized to any height from about 6 inches to 15 inches, and to any width from about 11 inches to about 21 inches, and to any depth from about 10 inches to about 18 inches by, for example, not limitation, ⅛ inch increments.

It would further be desirable to provide a simple means to attach the microwave oven liner to the microwave oven, once it has been resized to the dimensions appropriate to the given microwave oven for which it is to be used.

It would further be desirable to provide a means for protecting the front door of a microwave oven, in addition to protecting the sides, top, bottom, and back of the microwave oven.

It would further be desirable to provide a microwave oven liner which is fabricated from a material which has structural integrity and is able to free-stand in the microwave device on its own, requiring minimal or no supports, and without imposing undue setup requirements upon the liner user.

It would further be desirable for the liner to be durable under repeated microwave bombardment and heating, so that the liner remains free-standing after many microwave uses, and needs to be disposed of because of the spilled food that it has prevented from being caked on the microwave surface—not due to the liner becoming deformed from heat.

It would further be desirable for the microwave oven liner not to allow food to be absorbed or soaked into its surface, as this would cause the liner to stick to the microwave surface, defeating its purpose.

SUMMARY OF THE INVENTION

A preferred embodiment of the invention disclosed herein is a pleated microwave oven liner comprising a plurality of semi-rigid liner pleats that enable the microwave oven liner to be expanded from initial dimensions of approximately 6 inches in height by 11 inches in width, to final dimensions as large as approximately 15 inches in height by 21 inches in width, for example, not limitation, by ⅛ inch increments. As such, a single microwave oven liner can be produced which is suitable for use in microwave ovens over a wide range of varying sizes. The depth is varied from approximately 10 inches to 18 inches either by folding over the front of the liner on itself, or by removing part of the front of the liner, e.g. by cutting the liner, or by tearing the liner along perforated tear lines.

BRIEF DESCRIPTION OF THE DRAWING

The features of the invention believed to be novel are set forth in the appended claims. The invention, however, together with further objects and advantages thereof, may best be understood by reference to the following description taken in conjunction with the accompanying drawing(s) in which:

DETAILED DESCRIPTION OF THE INVENTION

Figure 1:
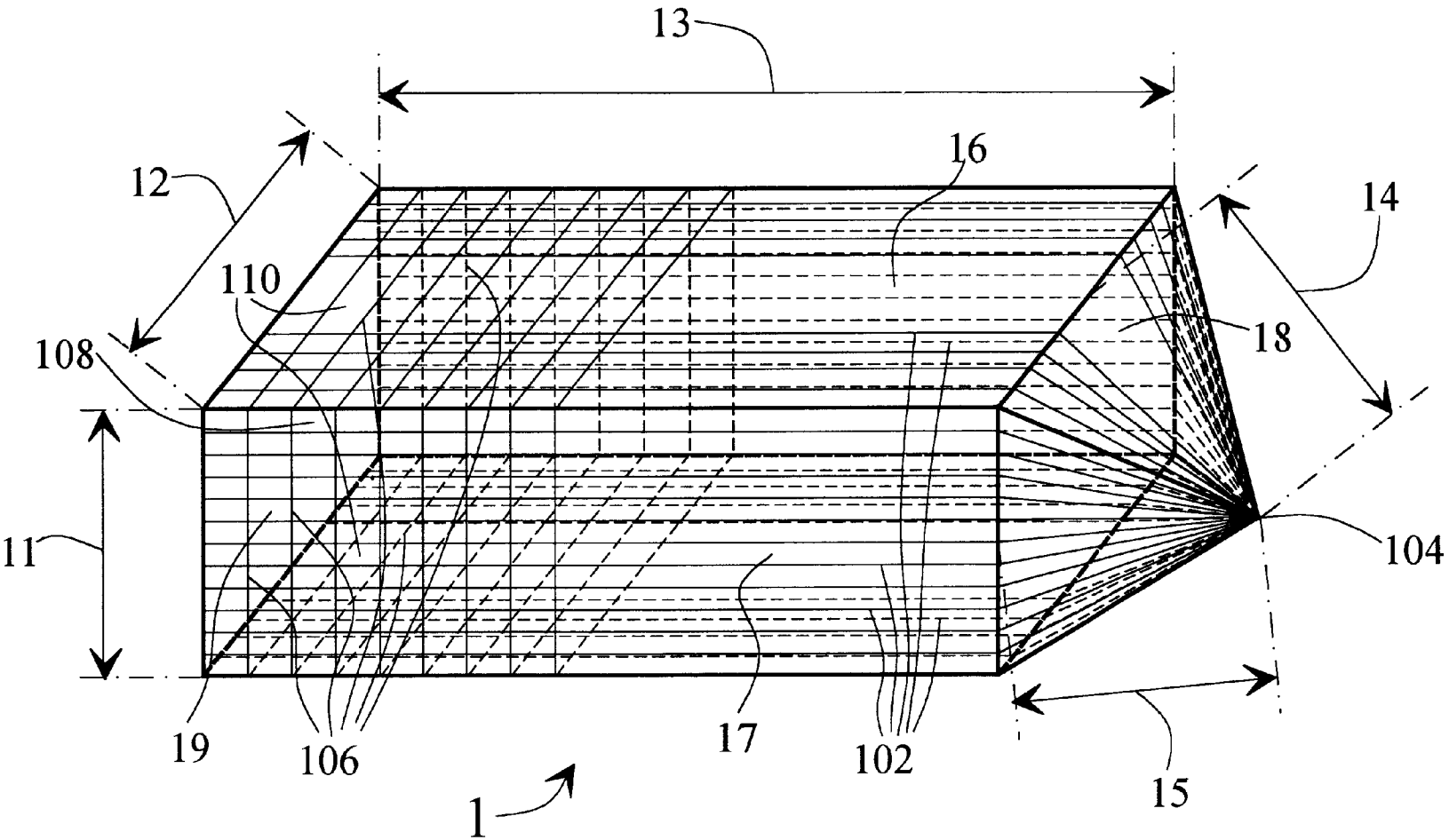
FIG. 1 is a top-rear-right side perspective view illustrating a resizable microwave oven liner in a preferred embodiment of the invention, in a fully collapsed state with all of its pleats closed.

FIG. 1 illustrates a top-rear-right side perspective view microwave oven liner 1 in a fully collapsed (unexpanded) state according to a preferred embodiment of the invention. In this fully collapsed state, microwave oven liner 1 has a height 11 of approximately 6 inches, a width 12 of approximately 11 inches, and a depth 13 of approximately 18 inches. The height and width are chosen to correspond with the smallest sizes of commonly-available microwaves as outlined above; the depth corresponds with the largest of such sizes. Toward its rear region (shown toward the right side of FIG. 1), microwave oven liner 1 comprises a rear surface comprising a "pyramid" surface with a linear dimension of approximately 7.5 inches along height expansion region 14 (a similar region, not marked with a reference numeral, exists on the opposite, lower face of the pyramid), and a linear dimension of approximately 10.5 inches along width expansion region 15 (as similar region, also not marked, exists on the opposite face of the pyramid).

Microwave oven liner 1 comprises a plurality of pleats 102 running horizontally along its top surface 16, its bottom surface 17, its left surface 18, and its right surface 19, substantially in the direction illustrated, as well as a front opening 108 which is fully open. Each pleat continues on through the pyramid surface to a pleat gathering point 104 comprising the tip (apex) of the aforementioned pyramid (at the rear of microwave oven liner 1, which again, is shown toward the right side of FIG. 1).

Microwave oven liner 1 also comprises a plurality of optional depth adjustment lines 106, such as but not limited to pre-cut perforations, which are used to adjust depth 13 of microwave oven liner 1. As illustrated, depth adjustment lines 106 run from left sides of top 16 and bottom 17 surfaces to right sides of top 16 and bottom 17 surfaces, and from tops of left 18 and right 19 side surfaces to bottoms of left 18 and right 19 side surfaces. The function of depth adjustment lines 106 will be further described in detail below, but it is to be observed at this point, if microwave oven liner 1 were to be cut along the rightmost depth adjustment line 106, that its depth would be reduced from approximately 18 inches to approximately 10 inches, which is the smallest depth of commonly-available microwaves.

Finally, microwave oven liner 1 comprises unpleated regions 110 along a central region of top surface 16 and a central region of bottom surface 17. It is to be noted that the lines 102 as illustrated in FIG. 1 representing the pleats do not illustrate the actual pleats themselves (which will be illustrated and discussed in further detail in connection with FIG. 3), but rather, the regions of microwave oven liner 1 which comprise the pleats, as well as the direction along which the pleats run along microwave oven liner 1.

Figure 2:
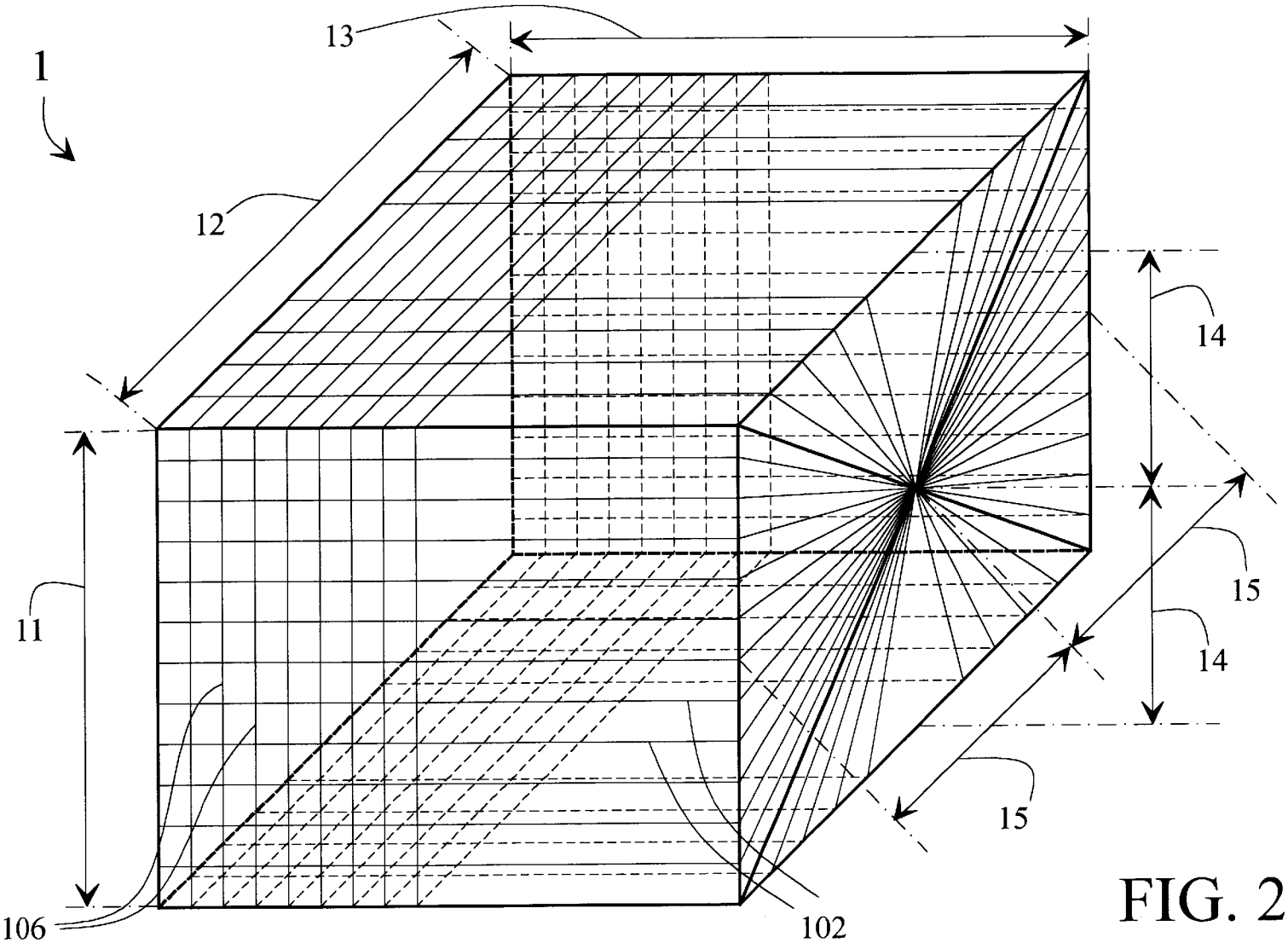
FIG. 2 is a top-rear-right side perspective view illustrating the resizable microwave oven liner of FIG. 1, in a fully expanded state with all of its pleats opened.

FIG. 2 illustrates the resizable microwave oven liner of FIG. 1, in a fully expanded state with all of its pleats opened. In its fully expanded state, microwave oven liner 1 now has a height 11 of approximately 15 inches (as opposed to approximately 6 inches in its fully collapsed state), and a width 12 of approximately 21 inches (as opposed to approximately 11 inches in its fully collapsed state). The depth 13 remains at 18 inches, but again, this depth is reduced by cutting or tearing microwave oven liner 1 (or folding it over on itself) along one of the depth adjustment lines 106. Again, by using the rightmost depth adjustment line 106, this depth is reduced to the 10 inch depth of the smallest-depth microwaves commonly available.

In this fully expanded state, the pyramid surface of FIG. 1 has become substantially flattened, because the "excess" liner material along height expansion region 14 and width expansion region 15 has been used to expand the rear of microwave oven liner 1 over the 9 inch expansion in height from 6 to 15 inches, and the 10 inch expansion in width from 11 to 21 inches. It can now be understood why height expansion regions 14 are chosen to be 7.5 inches, as this provides the necessary rear expansion liner material to allow the liner height to be expanded to 15=2 ×7.5 inches. It is similarly understood why width expansion regions 15 were chosen to be 10.5 inches, since this provides the necessary rear expansion liner material to allow the liner width to be expanded to 21=2×10.5 inches. In short, the two height expansion regions 14 are chosen such that their total length is approximately equal to the height of microwave oven liner 1 in its fully-expanded state, and the two width expansion regions 15 are chosen such that their total length is approximately equal to the width of microwave oven liner 1 in it fully-expanded state. As FIGS. 1 and 2 are drawn roughly to scale with one another, it is to be observed that the distances between pleat 102 lines is larger in FIG. 2 than in FIG. 1, which serves to represent the expansion that has taken place of the pleated sections. Again, these lines do not yet show the pleats themselves.

Figure 3:
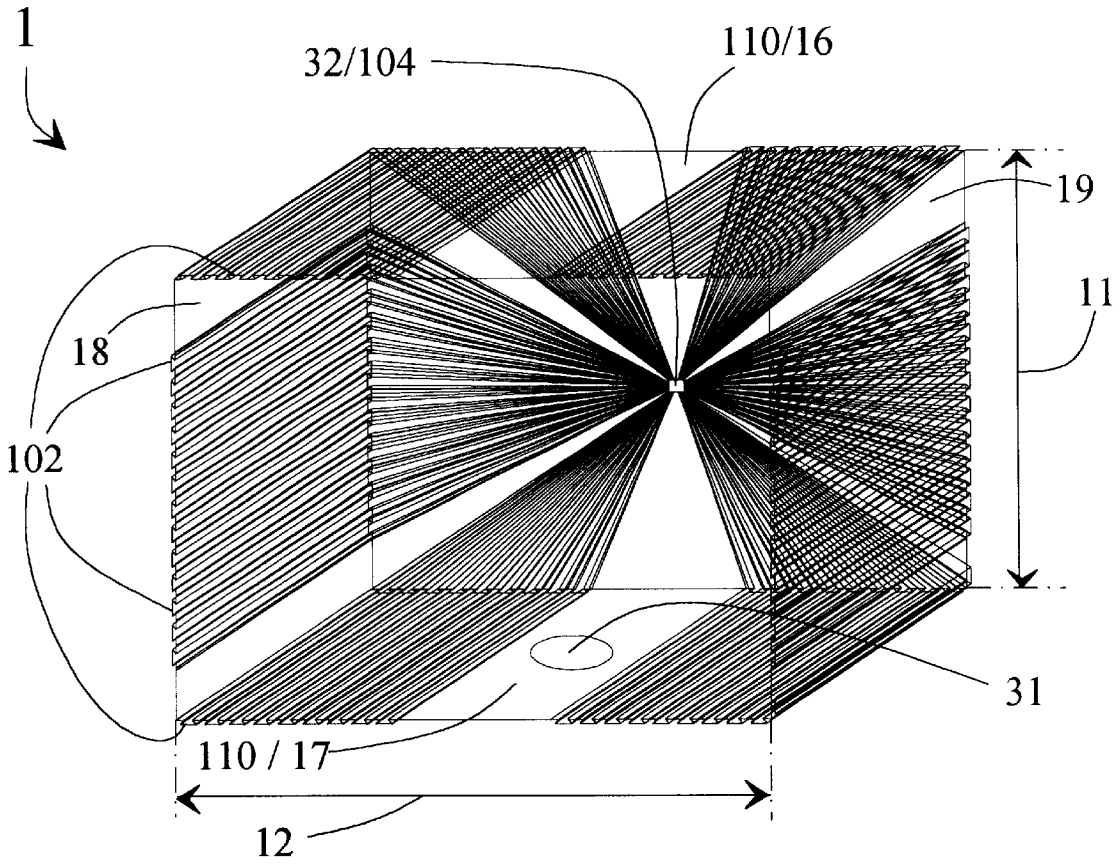
FIG. 3 is a top-front-right side perspective view illustrating the resizable microwave oven liner of FIG. 1, in a partially expanded state with its pleats partially opened, and illustrating in detail, the pleating apparatus and method according to said preferred embodiment of the invention.
Figure 4:
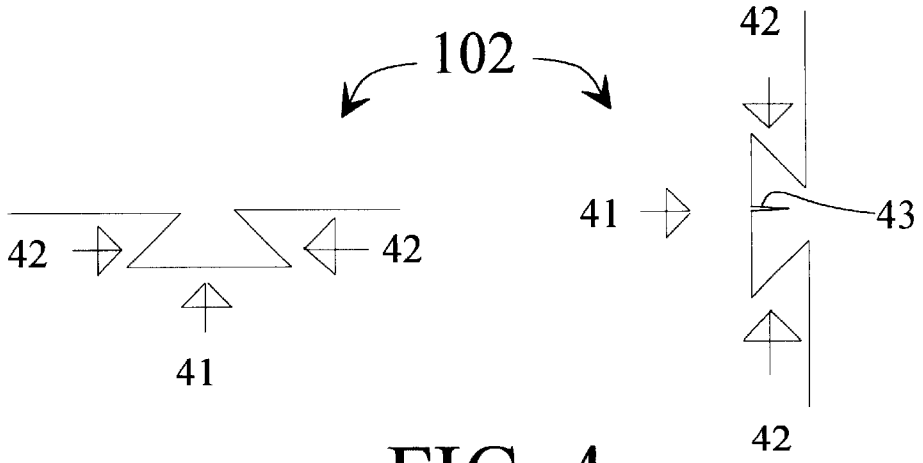
FIG. 4 is an exploded plan view illustrating single, partially opened pleats from FIG. 3.

FIG. 3 shows microwave oven liner 1 from a top-front-right perspective view. In this view, microwave oven liner 1 is partially expanded, and pleats 102, shown in detail here, are partially expanded. FIG. 4 illustrates single pleats 102 in more detail, in their partially-expanded states of FIG. 3. Toward the left of FIG. 4, is a single horizontal pleat, which is representative of a pleat along either the top surface 16 or bottom surface 17 of microwave oven liner 1. Toward the right of FIG. 4, is a single vertical pleat, which is representative of a pleat along either the left surface 18 or right surface 19 of microwave oven liner 1. The reasons for the difference between vertical and horizontal pleats will become apparent below; but it is worth noting for now that in the preferred embodiment, liner width 12 needs to be expandable from approximately 11 to 21 inches, which is less than a doubling of the width. In contrast, the height 11 needs to be expandable from approximately 6 to 15 inches, which is more than a doubling of the height, and in fact, is a 2.5-fold increase in height. In the partially-expanded state of FIG. 3, the pyramid near the rear of microwave oven liner 1, which cannot be seen from this view, is somewhat less-pronounced than it is in FIG. 1, but is not yet fully flattened as in FIG. 3.

Referring to FIG. 4, outer pleat surface 41 for a horizontal pleat 102, in the preferred embodiment, is chosen to be approximately ¼ inch in length, and pleat expansion surfaces 42 are chosen to be approximately ⅛ inch in length. Thus, as a single pleat 102 is unfolded from its fully collapsed state to its fully expanded state, this unfolding will add an extra ¼ inch =2×⅛ inch to the overall width of microwave oven liner 1, and the individual pleat 102 will itself unfold from ¼ inch to ½ inch, i.e., it will double in size. As it is desired in the embodiment of FIGS. 1 through 3 to expand the width to be anywhere from 11 inches to 21 inches, i.e., a total up to 10 inches, a total of 40=10/(2×⅛) pleats 102 are necessary along liner width 12. These 40 pleats, when fully collapsed, are ¼ inch each, and will thus yield a total of 10=40×¼ inches in liner width 12. The extra 1 inch, is provided by unpleated regions 110, bringing the unexpanded width to 11=10+1 inches. When these 40 pleats are fully expanded, they will double in size to ¼ inch each, and will thus yield a total of 20=40×¼ inches in liner width, with the extra 1 inch from unpleated regions 110 bringing the fully-expanded width of 21=20+1 inches. It is assumed here, and throughout, that each pleat 102 is adjacent to the next pleat 102 as closely as possible, but without overlap. Of course, the above described configuration is illustrative only, and can obviously be varied by someone ordinary skill in the art, within the scope of this disclosure and its associated claims.

In contrast, pleats 102 along height 11 of microwave oven liner 1 take the form of the pleat shown toward the right of FIG. 4, and include, for example, a pleat extender section 43 comprising additional material that enables each pleat to expand by a factor of greater than 2 to 1. This is because the height 11 of microwave oven liner 1, in order to accommodate all conventional microwave sizes, must increase from 6 to 15 inches. It is apparent on close inspection, that the pleats shown toward the left of FIG. 4 can gain at most a 2 to 1 expansion, and that simple adding more pleats will not resolve this, but will merely increase the unexpanded height 11 of microwave oven liner 1 beyond the desired 5 inches.

Thus, the vertical pleats 102 are similar to the earlier-described horizontal pleats 102, but comprise added pleat extender sections 43 comprising two halves of approximately 1/16 inch in length apiece. When these pleats—which start off in their contracted state at ¼ inch apiece—are fully expanded, they gain ¼ inch=2×⅛ inch from each of the two pleat expansion surfaces 42, as well as an additional ⅛ inch=2×1/16 inch from each of the pleat extender sections 43. Thus, the overall gain per pleat is ⅜ inch=¼ inch (from 42)+⅛ inch (from 43), and each pleat thus expands from ¼ inch to ⅝ inch=¼ inch+⅜ inch. This is a gain of 2.5 to 1 (i.e., ⅝ to ¼) per pleat, which mirrors the overall gain need to go from 6 inches to 15 inches in height 11. Thus, with a total of 24 such pleats 102, one can expand from 6 inches=24 pleats×¼ inch per pleat, to 15 inches=24 pleats×⅝ inch per pleat. Here, no unpleated region such as 110 is needed.

It is to be noted that FIG. 3 actually shows approximately 20 pleats along width 12, and approximately 18 pleats along height 11. This is done simply to avoid overcrowding the drawing; thus if all of the aforementioned dimensions for the preferred embodiment of FIGS. 1 through 3 are to be employed in a particular reduction to practice, FIG. 3 actually illustrates approximately one pleat horizontal pleat to represent approximately every two horizontal pleats that are needed for the reduction to practice, and approximately 3 vertical pleats for every 4 that are needed for reduction to practice. Alternatively, for example, if outer pleat surface 41 were chosen to be ¼ inch, pleat expansion surfaces 42 were chosen to be ¼ inch, and the two halves of pleat extender sections 43 were chosen to be approximately ⅛ inch in length apiece, then FIG. 3 would illustrate substantially a one-to-one correspondence between the number of pleats required, and the number represented in FIG. 3.

The ⅛ inch pleat expansion surfaces 42 and 1/16 inch pleat extender sections 43 are chosen for the preferred embodiment, since they provide expansion in ⅛ inch increments if half of a single pleat 102 is unfolded, in ¼ inch increments if an entire pleat 102 is unfolded and in ⅜ inch increments if a pleat extender sections 43 is also unfolded. This is desirable since the dimensions of commonly-available microwaves typically vary in ⅛ or ¼ inch increments, and this provides greater incremental expansion capability.

It will be obvious to someone of ordinary skill how to vary and generalize all of the aforementioned choices of pleat dimension as well as the number of pleats, at will, to provide any desired overall expansion of height 11 and width 12 for microwave oven liner 1. Any such variation or generalization is considered to be within the scope of this disclosure and its associated claims. In particular, the choice of having height 11 vary from 6 inches to 15 inches, width 12 vary from 11 inches to 21 inches, and depth 13 vary from 10 inches to 18 inches, is not made in the abstract; but is made to accommodate the sizes of microwaves as they are customarily manufactured. If microwaves were to be manufactured which exceed one or more of the maximum dimensions noted above, or are smaller along one or more of the minimum dimensions noted above, then the specifications for microwave oven liner 1 can easily and obviously be varied to accommodate this. Similarly, once the suitable maximum and minimum dimensions have been specified for microwave oven liner 1, one can vary the individual pleat 102 specifications as desired, recognizing the simple and obvious generalizations of the relationships among individual pleat characteristics, number of pleats, and desired size ranges, as outlined above for the preferred embodiment outlined above and chosen by way of example only, not limitation.

Similarly, depth adjustment lines 106 are for illustration only, and may be incorporated into microwave oven liner 1 as desired. For example, not limitation, these can be separated by ¼ or ⅛ inch from one another to accommodate the ¼ or ⅛ inch depth increments that are typical in commonly-available microwave ovens. And the range of depth from 10 inches to 18 inches that is achieved by these depth adjustment lines 106 is again based on the depth of commonly-available microwave ovens. If ovens with larger depths than 18 inches, or smaller depths than 10 inches, were to become available, it would be obvious how to modify the specifications for microwave oven liner 1 in order to accommodate this.

Figure 5:
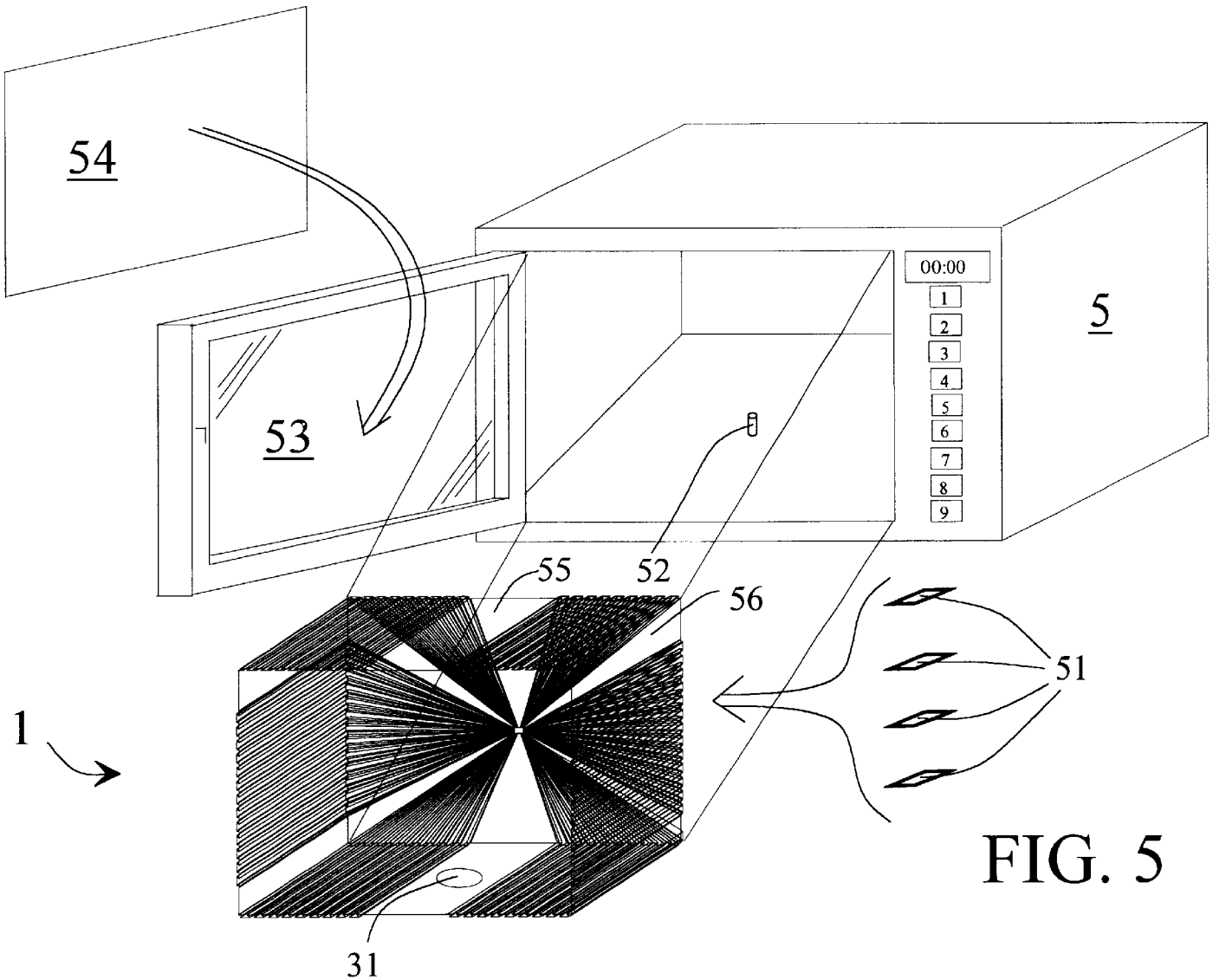
FIG. 5 is a perspective view illustrating the placement of the microwave oven liner of FIG. 1 into a microwave oven, as well as a separate microwave door liner used to protect the inside of the front microwave oven door.

FIG. 3 also illustrates a turntable aperture 31 along unpleated region 110 of bottom surface 17 through which the spindle of a microwave turntable can pass when microwave oven liner 1 is placed into a microwave oven 5 (see FIG. 5). Also illustrated is a pleat gathering means 32 proximate a pleat gathering point 104, which may comprise, for example, not limitation, a microwave-safe (e.g. plastic, ceramic) staple or constricting ring designed to hold together the pleats 102 near the pyramid apex so that they do not fall apart toward the rear of the liner as microwave oven liner 1 is being expanded. It is to be observed that the pleats 102 along the pyramid surface of microwave oven liner 1 are simply extensions of the pleats 102 along the top 16, bottom 17, and sides 18 and 19 of microwave oven liner 1, gathered together to all join up and be gathered together at pleat gathering point 104.

FIG. 5 illustrates the placement of microwave oven liner 1 into a microwave oven 5. Prior to placing microwave oven liner 1 into microwave oven 5, pleats 102 are unfolded until microwave oven liner 1 is enlarged to accommodate the height and width of the particular microwave oven 5 with which the liner is to be used. FIGS. 1 through 3 of course, illustrate microwave oven liner 1 at various stages of expansion, from fully-contracted (FIG. 1) through partially-expanded (FIG. 3), through fully-expanded (FIG. 2). If microwave oven liner 1 includes optional depth adjustment lines 106, then microwave oven liner 1 is also torn, cut or folded over itself along a chosen depth adjustment line 106 to size microwave oven liner 1 to the depth necessary to accommodate the microwave oven 5 for which it is being used. If optional depth adjustment lines 106 are not included, then microwave oven liner 1 is still folded in on itself to the necessary depth, or, alternatively, is cut to the proper depth using commonly-available cutting means such as, but not limited to, scissors. The term "depth reduction means" as used herein, refers to any suitable means used to reduce the depth of microwave oven liner 1, including, but not limited to, depth adjustment lines 106 earlier discussed, cutting by any suitable cutting means even in the absence of depth adjustment lines 106, folding the liner over on itself even in the absence of depth adjustment lines 106, etc.

Once the height 11, width 12 and depth 13 of microwave oven liner 1 are adjusted to fit microwave oven 5, microwave oven liner 1 is then inserted into microwave oven 5 as shown. Liner-to-oven securing means 51 are placed upon and attached to microwave oven liner 1 at one or more suitable securing locations, and then, as microwave oven liner 1 is inserted into microwave oven 5, are pressed against and attached to the inside surface of microwave oven 5 on the top, bottom, side and/or rear interior walls of microwave oven 5. Liner-to-oven securing means 51 may be, for example, not limitation, double sided tape separate from microwave oven liner 1, or tape already pre-attached to microwave oven liner 1 at one or more suitable securing locations. During this insertion process, if microwave oven 5 has a turntable, the turntable is removed, turntable spindle aperture 31 is placed over the turntable spindle 52 upon which the turntable rests, and the turntable is then placed back upon the spindle. The rear, pyramid surface of oven liner 1 is "scrunched" as necessary against the rear of the microwave oven so that it is substantially flush against the rear of the microwave oven, irrespective of how large or small the pyramid might be.

At this point, the top, bottom, rear, and both side interior walls of microwave oven 5 are protected from spatter by microwave oven liner 1. But it is also desirable to protect microwave oven front door 53. An optional front door liner sheet 54, separate from oven liner 1, is used for this purpose. Front door liner 54 is simply attached to microwave front door 53 as shown, also using liner-to-oven securing means 51. Because most microwave oven front doors 53 have a window through which the inside of microwave oven 5 can be viewed from outside while front door 53 is closed, in the preferred embodiment, front door liner 54 is transparent so as to not obstruct this view.

Many microwave ovens 5 also contain a platform (not shown) attachable to platform support brackets (not shown) on the rear and sides of microwave oven 5. Such a platform is used to support a food item being heated substantially near the center of the oven. If microwave oven 5 contains such a platform and platform supports, microwave oven liner 1 is also pressed firmly over these supports and deformed or torn at the support region such that the supports, or the shape of the supports, will protrude through microwave oven liner 1 in order to support the platform. The platform is then placed over the supports, or over the sections of microwave oven liner 1 that envelop these supports.

It is also understood, while microwave oven liner 1 shows all of a pleated top surface 16, bottom surface 17, left surface 18, right surface 19, and rear surface comprising the pyramid surface earlier shown and described, that an alternative embodiment could leave out the rear surface, and simply include pleated top, bottom and side surfaces embodied in a four-sided, rather than a five-sided liner apparatus 1. In this embodiment, the rear surface of microwave oven 5 can alternatively be protected, for example, by a separate rear surface liner sheet substantially similar to separate front door liner sheet 54.

Ideally, the liner material used to construct microwave oven liner 1 should have structural integrity and be able to free-stand in the microwave device on its own, requiring minimal or no supports. This material should still be free-standing after many microwave uses, and should need to be disposed of because of the spilled food that it has prevented from being caked on the microwave surface—not due to the liner becoming deformed from heat. The ideal material should also not allow food to be absorbed or soaked into its surface, as this would cause the liner to stick to the microwave surface, defeating its purpose.

Therefore, materials meeting the requirements would be able to withstand repeated microwave bombardment and not become distorted from the water vapor or steam resulting from routine food preparation. High-density polyethylene, high-density polypropylene, high-density polystyrene, polycarbonates, polyethylene, polypropylene, polystyrene, and blends containing these polymers meet these requirements. These materials have a high heat distortion temperature and therefore can withstand repeated microwave bombardment and the steam that results in day-to-day food preparation. They also will not absorb food spatters into their surface.

It is also to be noted that many microwave ovens 5 contain lights to light their interior region, and/or fans for air circulation. It may therefor be desirable for the material used to fabricate liner 1 to have, for example, a transparent or cutout (e.g., using perforations) region 55 proximate the light location, and to have, e.g., vent regions 56 (e.g., small aperture vents) for air passage proximate any air fans. It is understood that the proper location for these light and air passages will likely vary from one microwave model to the next, due to differing placements of lights and fans on different microwave models, and that locations 55 and 56 are simply marked as an example.

Figure 6:
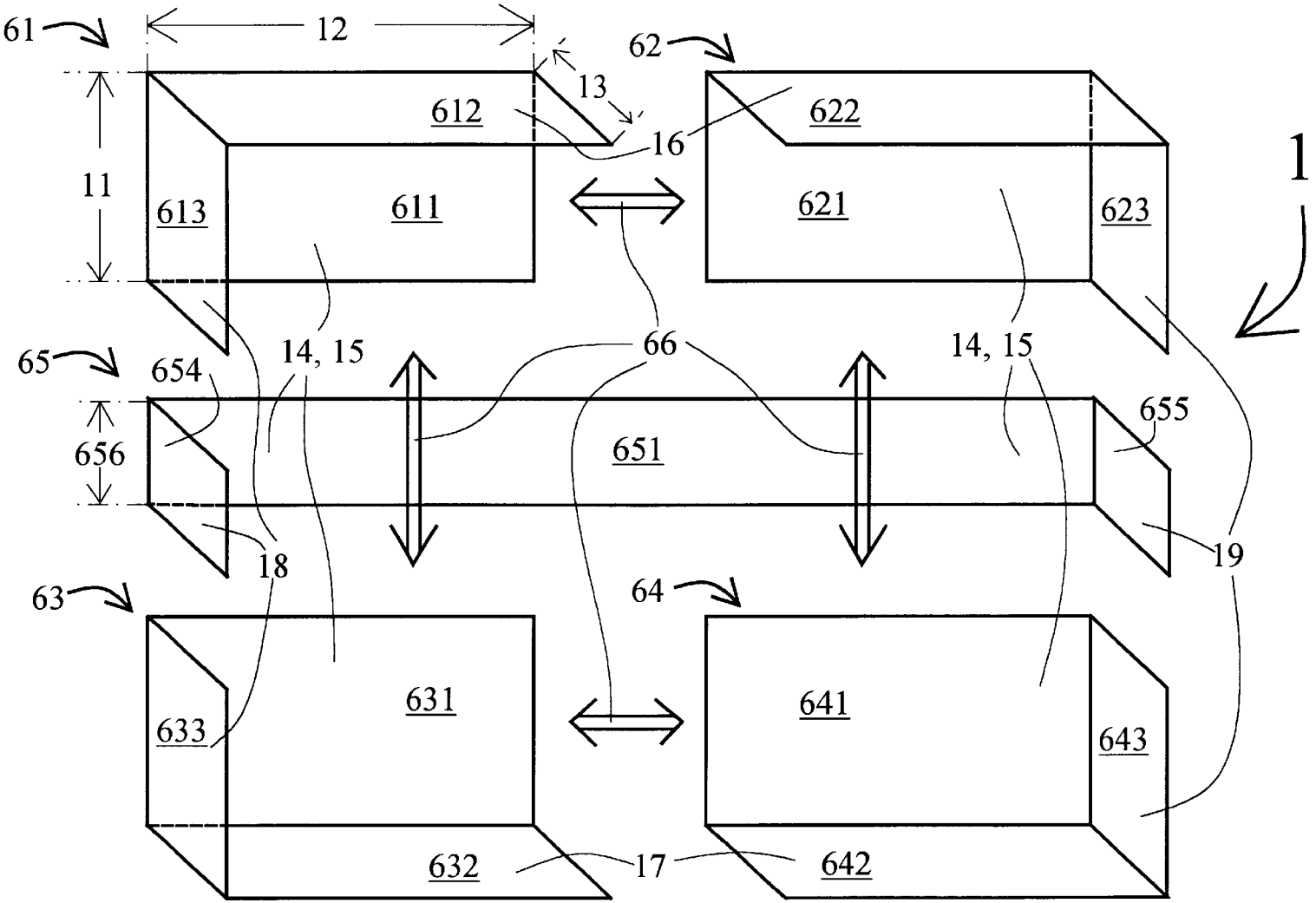
FIG. 6 is an upper-front-left perspective view of an alternative preferred embodiment of the invention wherein the microwave oven liner comprises four or five distinct sections without any pleating structure.

In an alternative preferred embodiment illustrated by FIG. 6, the pleating structure is eliminated entirely, and microwave oven liner 1 comprises four distinct and separate microwave oven liner quadrant sections, as opposed to the continuous, unitary structure of FIGS. 1 through 5. In this embodiment, microwave oven liner 1 comprises an upper left quadrant 61, an upper right quadrant 62, a lower left quadrant 63, and a lower right quadrant 64. Each of these quadrants in turn comprises three surfaces which are slidably overlapped into one another as illustrated by expansion/contraction lines 66 so that the size of the overall microwave oven liner 1 formed by the combination of all four quadrants can be suitably matched to the size of microwave oven 5.

In particular, liner-to-oven securing means 51 are used at suitable locations on the surface of microwave oven liner 1 to secure each quadrant to the interior of microwave oven 5 so as to achieve complete coverage of the top, bottom, side, and rear walls of microwave oven 5. Upper left quadrant 61 comprises upper left quadrant rear 611, top 612 and left side 613 surfaces which are respectively secured to the rear, top and left walls of microwave oven 5 toward the upper left of microwave oven 5. Upper right quadrant 62 comprises upper right quadrant rear 621, top 622 and right side 623 surfaces which are respectively secured to the rear, top and right walls of microwave oven 5 toward the upper right of microwave oven 5. Lower left quadrant 63 comprises lower left quadrant rear 631, bottom 632 and left side 633 surfaces which are respectively secured to the rear, bottom and left walls of microwave oven 5 toward the lower left of microwave oven 5. Finally, lower right quadrant 64 comprises lower right quadrant rear 641, bottom 642 and right side 643 surfaces which are respectively secured to the rear, bottom and right walls of microwave oven 5 toward the lower right of microwave oven 5.

Once these microwave oven liner quadrant sections 61, 62, 63 and 64 have been secured to microwave oven 5, there is some partial overlapping of these various surfaces 611, 612, 613, 621, 622, 623, 631, 632, 633, 641, 642, and 643, depending on the size of microwave oven 5. In this embodiment, the rear liner surface earlier discussed in reference to expansion regions 14 and 15 comprises partially-overlapping rear quadrant surfaces 611, 621, 631, and 641. Microwave oven liner top surface 16 comprises partially-overlapping upper quadrant surfaces 612 and 622. Microwave oven liner bottom surface 17 comprises partially-overlapping lower quadrant surfaces 632 and 642. Microwave oven liner left side surface 18 comprises partially-overlapping left side quadrant surfaces 613 and 633. Finally, microwave oven liner right said surface 19 comprises partially-overlapping right side quadrant surfaces 623 and 643.

It is to be recalled that microwave oven liner 1 needs to be expandable in height between approximately 6 and 15 inches, in width between approximately 11 and 21 inches, and in depth between approximately 10 inches and 18 inches. Thus, each of these quadrants preferably has a height 11 of approximately 6 inches, a width 12 of approximately 11 inches, and a depth 13 of approximately 18 inches. To accommodate depth adjustment, the depth of these quadrants can be trimmed or folded from 18 down to 10 inches as discussed earlier in reference to the embodiments of FIGS. 1 through 5, using, for example, not limitation, the optional depth adjustment lines 106 of FIGS. 1 and 2. With an 11 inch width per quadrant, the width of microwave oven liner 1 can be varied from 11 to 22 inches depending on the degree of width overlap, thus accommodating the required width adjustment. However, the problem earlier discussed in reference to FIG. 4 regarding the need to expand the height of microwave oven liner 1 by a factor of greater than 2 to 1 still applies here. Thus, if each quadrant has a height 11 of approximately 6 inches as just stated, it will not be possible to expand the height of microwave oven liner 1 to greater than 12 inches without further accommodations. There are several options for this, as discussed below.

One option, as also illustrated in FIG. 6, is to provide a fifth microwave oven liner section such as the illustrated midsection height extender strip 65 comprising height extender strip rear 651, left side 654 and right side 655 surfaces. Height extender strip 65 has a height 656 of approximately 3 or more inches, and is only needed for microwaves of greater than 12 inches in height. Height extender strip 65 is similarly attached to microwave oven 5 using liner-to-oven securing means 51, so as to cover the gap between the upper quadrants 61, 62 and the lower quadrant 63, 64 when these are secured to a microwave oven 1 of greater than 12 inches in height. This affords protection the interior surfaces of microwave oven 5 that would otherwise be exposed between upper quadrants 61, 62 and the lower quadrant 63, 64. For microwave ovens of less than 12 inches in height, height extender strip 65 is unnecessary.

Figure 7:
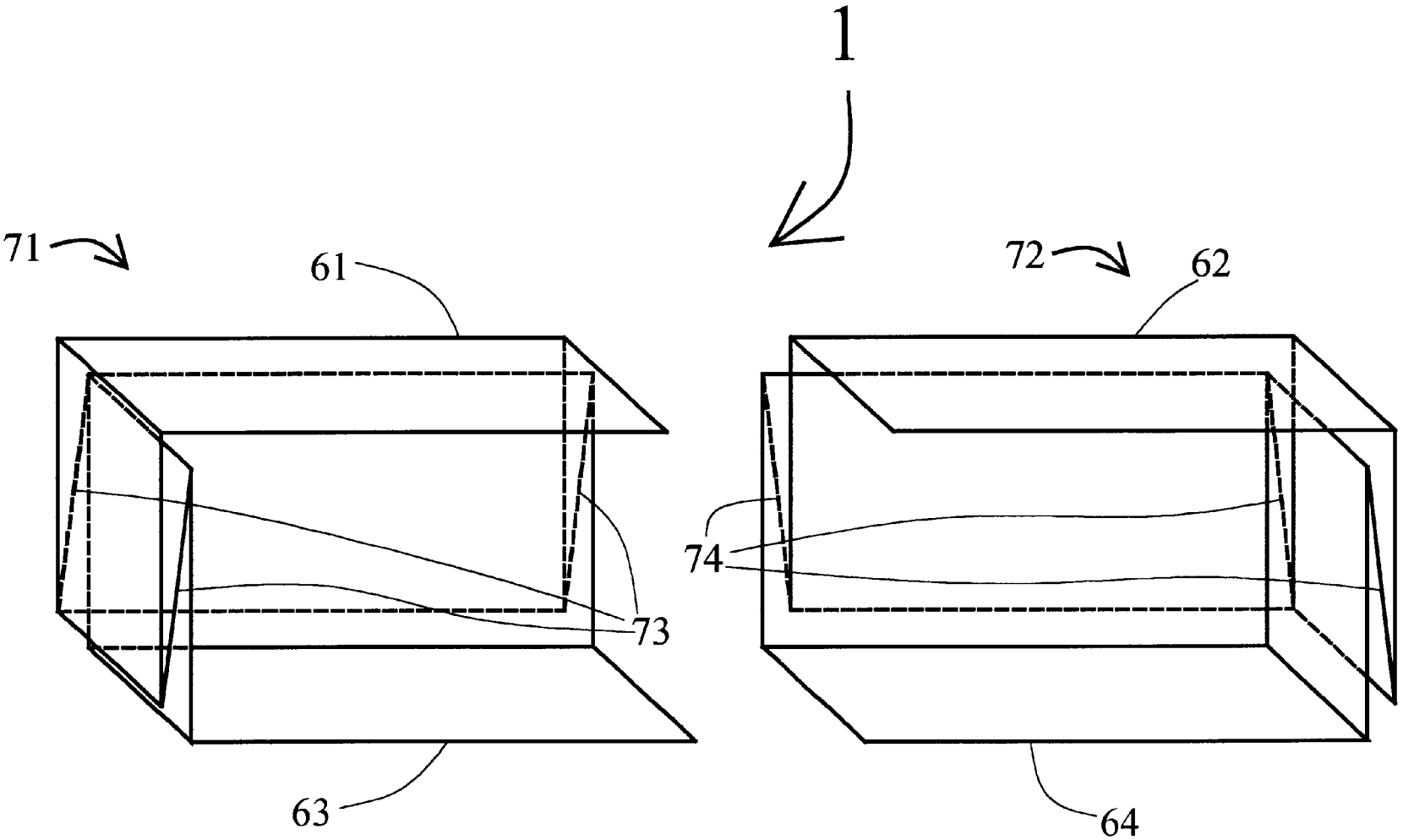
FIG. 7 is an upper-front-left perspective view of an alternative preferred embodiment of the invention wherein the microwave oven liner comprises two distinct section with a single pleat for vertical expansion, in its fully collapsed state.
Figure 8:
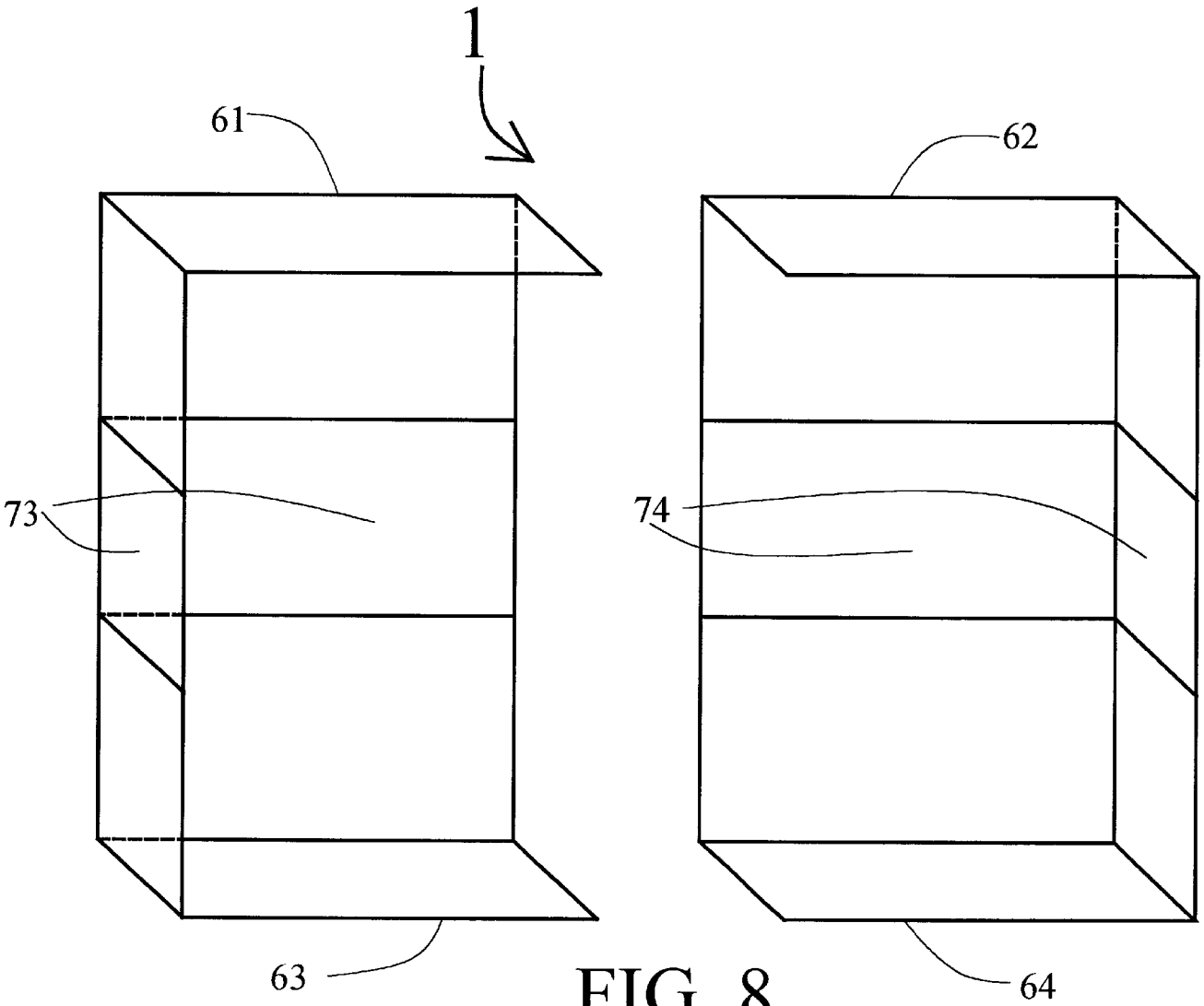
FIG. 8 is an upper-front-left perspective view of the embodiment of FIG. 7, in its fully expanded state.

Another option, illustrated in FIGS. 7 and 8, uses two distinct and separate microwave oven liner half sections. In this embodiment, microwave oven liner 1 comprises a left half 71, and a right half 72. Left half microwave oven liner comprises an upper left quadrant 61 and a lower left quadrant 63 similarly to FIG. 6, as well as an expandable left half vertical pleating structure 73 comprising, in this illustration, for example, not limitation, a single vertical pleat adjoining upper left quadrant 61 and lower left quadrant 63. Right half microwave oven liner comprises an upper right quadrant 62 and a lower right quadrant 64 similarly to FIG. 6, as well as an expandable right half vertical pleating structure 74 comprising, in this illustration, for example, not limitation, a single vertical pleat adjoining upper right quadrant 62 and lower right quadrant 64. Thus, this vertical pleating structure on the left and right sides, as well as in the rear, takes the place of height extender strip 65 so as to protect the mid-height region of microwave oven 5 and enable the greater than 2 to 1 height expansion required to accommodate microwave ovens 5 ranging in height from 6 to 15 inches.

Many variations from the above will certainly occur the those of ordinary skill in the art, and are considered to fall within the scope of this disclosure and its associated claims. For example, the embodiment of FIG. 6 could also be used without any of the rear surfaces 611, 621, 631, 641 so as to cover only the top, bottom and sides of microwave oven 5.

In the fully-collapsed state of FIG. 7, microwave oven liner 1 needs to be approximately 6 inches high, while in the fully-expanded state of FIG. 8, microwave oven liner 1 needs to be approximately 15 inches high. A simple algebraic calculation reveals that if the height of the upper and lower quadrants are to chosen to be substantially equal, then the height of each quadrant should be chosen to be approximately 5.25 inches, while the length (height) of the vertical pleating structures 73 and 74 should be chosen to be approximately 4.5 inches. Thus, when fully collapsed as in FIG. 7, microwave oven liner 1 will be 6=5.25+5.25−4.5 inches high, and when fully expanded as in FIG. 8, microwave oven liner 1 will be 15=5.25+5.25+4.5 inches high. In the intermediate states, the left and right halves are expanded to the desired height, and the excess pleating may then be "scrunched" as necessary. Liner-to-oven securing means 51 is again used to secure microwave oven liner 1 to microwave oven 5.

In light of the above, many other variations may also occur to someone of ordinary skill which are considered to be within the scope of this disclosure and its associated claims. For example, not limitation, the embodiment of FIG. 6 can be varied so as to eliminate the rear surfaces 611, 621, 631, and 641, and thus only cover the top, bottom and sides of microwave oven 5. Then, a separate liner can be applied directly to the rear of microwave oven 5.

Another variation, for example, not limitation, is for left half vertical pleating structure 73 and right half vertical pleating structure 74 to comprise a plurality of vertical pleats, for example, in an accordion-like structure, or, for example, in the side pleating structures earlier shown and described in connection with the embodiment of FIGS. 1 through 5.

Figure 9:
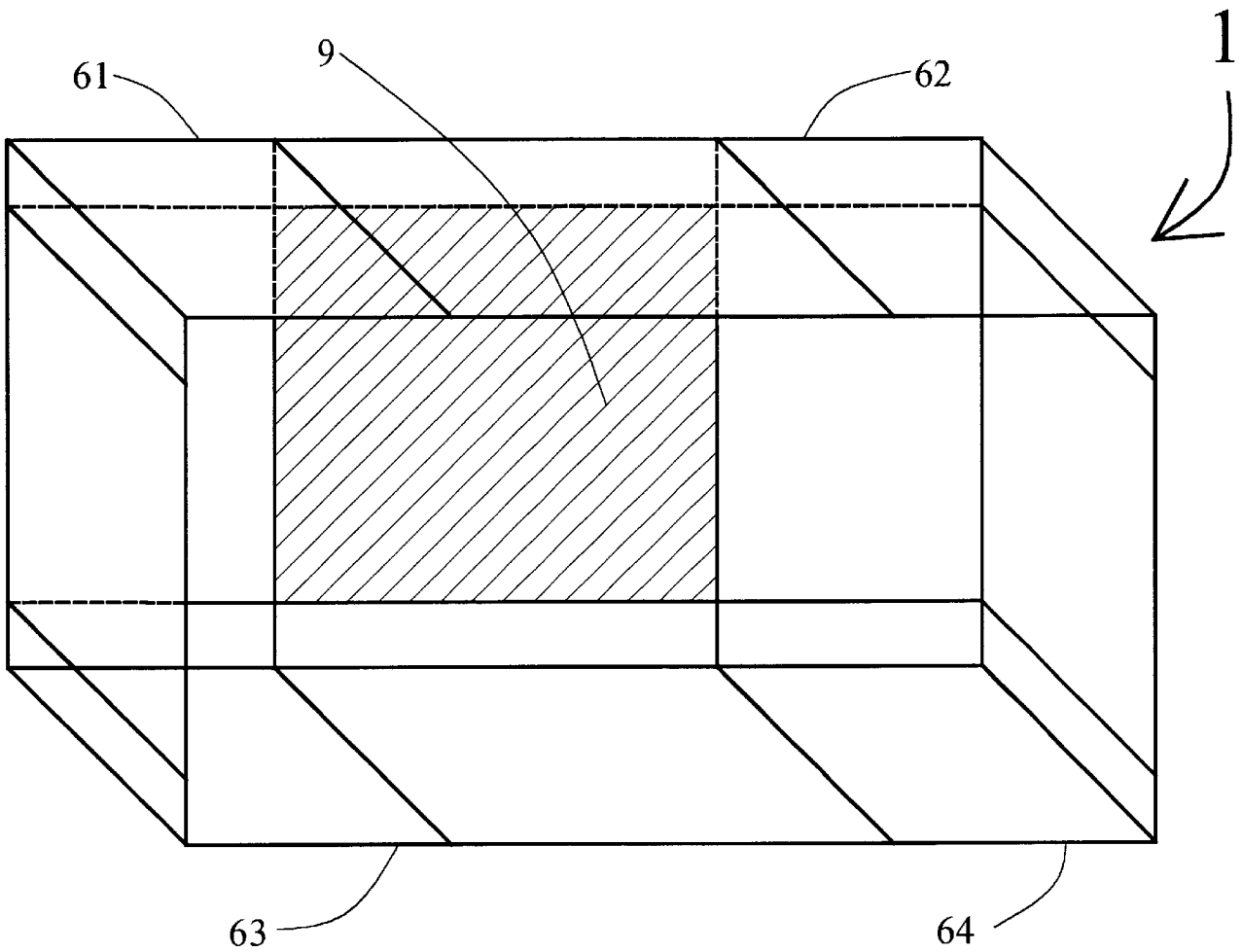
FIG. 9 is an upper-front-left perspective view of a third preferred embodiment which schematically illustrates the microwave oven liner comprising a unitary structure with a single pleat for vertical expansion, and a single pleat for horizontal expansion, in its fully collapsed state

A third preferred embodiment, for example, not limitation, illustrated in FIG. 9, is for all four quadrants of microwave oven liner 1 to comprise a continuous, unitary structure as in the embodiment of FIGS. 1 through 5, but using only a single pleat for expansion as in FIGS. 7 and 8. Once the vertical pleats are provided similarly to FIGS. 7 and 8, a horizontal pleating structure such as but not limited to a single horizontal pleat similar to single vertical pleats 73 and 74 can be introduced between the pleated left half 71 and the pleated right half 72. To cover the full width range from 11 to 21 inches, the horizontal pleat is optimally selected to be about 5 inches, while the horizontal width of each quadrant is selected to be about 8 inches. Then, when fully collapsed along its width, the width of microwave oven liner 1 will measure approximately 11=8 +8−5 inches, and when fully expanded along its width, the width of microwave oven liner 1 will measure approximately 11=8 +8+5 inches. In this embodiment, the vertical and horizontal expansion pleats will intersect each other at a center intersection region 9 (shaded) of the liner rear surface in a plus sign (+) configuration, but the earlier-described pyramid is eliminated. In FIG. 9, which is drawn substantially to scale, microwave oven liner 1 is fully collapsed, is 6 inches high by 11 inches wide, has a single vertical pleat which is 4.5 inches high, and has a single horizontal pleat which is 5 inches wide. There is 0.75 inches of unpleated height above and below the vertical pleat, and there is 3 inches of unpleated width to the left and right of the horizontal pleat. FIG. 9 is a schematic illustration insofar as it illustrates the pleating regions, but does not show the pleats themselves.

Another variation, for example, not limitation, is to provide the microwave oven liner of FIGS. 7, 8, and/or 9 with a plurality pleat structure such as an accordion-like pleat structure, or a similar type of pleating structure that would be obvious to someone of ordinary skill, rather than the single pleat structure discussed above. The vertical and horizontal expansion pleats will still intersect each other in a plus sign (+) configuration in the shade region 9, but the height and width of the pleating regions will vary depending on the particular plurality pleating structures that are chosen.

In all embodiments, the calculations to determine the appropriate height and width for each quadrant, as well as the for the pleating structures, will of course depend upon the particular pleating structure being employed. But it is understood that this should be a simple and obvious calculation that, in light of this disclosure, and within the scope of the associated claims, can easily be performed by someone of ordinary skill.

While only certain preferred features of the invention have been illustrated and described, many modifications and changes will occur to those skilled in the art. It is, therefore, to be understood that the appended claims are intended to cover all such modifications and changes as fall within the true spirit of the invention.

We claim:

1. A microwave oven liner, comprising:

a top surface;

a bottom surface;

a left side surface; and a right side surface; wherein:

said top and bottom surfaces are capable of being expanded from a fully collapsed state of predetermined minimum width to a fully expanded state of predetermined maximum width, and to an intermediate expansion state of any chosen width between said minimum width and said maximum width;

said left and right side surfaces are capable of being expanded from a fully collapsed state of predetermined minimum height to a fully expanded state of predetermined maximum height, and to an intermediate expansion state of any chosen height between said minimum height and said maximum height;

said microwave oven liner is capable of being placed into a microwave oven substantially proximate respective top, bottom, left side, and right side interior walls of an interior of said microwave oven;

said microwave oven liner comprises a liner material capable of withstanding microwave bombardment; and said predetermined maximum height exceeds said predetermined minimum height by a factor of greater than approximately 2 to 1.

2. The microwave oven liner of claim 1:

said top and bottom surfaces comprising at least one horizontal pleat running from a front of said top and bottom surfaces to a rear of said top and bottom surfaces, enabling said top and bottom surfaces to be so-expanded; and said left and right side surfaces comprising at least one vertical pleat running from a front of said left and right side surfaces to a rear of said left and right side surfaces, enabling said left and right side surfaces to be so-expanded.

3. The microwave oven liner of claim 2, further comprising:

a rear surface capable of being placed into said microwave oven substantially proximate a rear interior wall of said microwave oven, comprising at least one rear surface pleat running from said rear of said top, bottom, left, and right side surfaces to a pleat gathering point, wherein:

said rear surface, when said microwave oven liner is in said fully collapsed state, forms a pyramid surface with said pleat gathering point proximate an apex of said pyramid surface; and wherein said rear surface, when said microwave oven liner is in said fully expanded state, becomes substantially flattened.

4. The microwave oven liner of claim 1, further comprising:

a rear surface liner sheet separate from said top, bottom, left side, and right side surfaces, capable of being placed into said microwave oven substantially proximate a rear interior wall of said microwave oven.

5. The microwave oven liner of claim 1, further comprising:

a front door liner sheet separate from said top, bottom, left side, and right side surfaces, capable of being placed into said microwave oven substantially proximate a front door of said microwave oven.

6. The microwave oven liner of claim 1, wherein said top, bottom, left side and right surfaces are capable of being reduced from a predetermined maximum depth to a predetermined minimum depth, and to an intermediate state of any chosen depth between said maximum depth and said minimum depth.

7. The microwave oven liner of claim 6, further comprising a plurality of depth adjustment lines running from left sides of said top and bottom surfaces to right sides of said top and bottom surfaces, and from tops of said left and right side surfaces to bottoms of said left and right side surfaces, enabling said depth to be so-reduced.

8. The microwave oven liner of claim 1, further comprising:

liner-to-oven securing means securing said microwave oven liner to at least one location upon said microwave oven interior.

9. The microwave oven liner of claim 1, said microwave oven liner further comprising a liner material which:

possesses sufficient structural rigidity to freely stand within said microwave oven without any additional independent support structure;

maintains said structural rigidity throughout repeated microwave bombardment and heating; and substantially does not absorb food spatter.

10. The microwave oven liner of claim 1, said oven liner further comprising a liner material selected from the polymer group consisting of:

high-density polyethylene; high-density polypropylene; high-density polystyrene; polycarbonates; polyethylene; polypropylene; polystyrene; and blends comprising more than one of high-density polyethylene; high-density polypropylene; high-density polystyrene; polycarbonates; polyethylene; polypropylene; and polystyrene.

11. The microwave oven liner of claim 1, said microwave oven liner further comprising at least one transparent region enabling light to pass therethrough.

12. The microwave oven liner of claim 1, said microwave oven liner further comprising at least one venting region enabling air to pass therethrough.

13. The microwave oven liner of claim 1, further comprising:

a rear surface capable of being placed into said microwave oven substantially proximate a rear interior wall of said microwave oven when said top, bottom, left side and right side surfaces are in a given said state of expansion.

14. The microwave oven liner of claim 1:

said left and right side surfaces comprising at least one vertical pleat running from a front of said left and right side surfaces to a rear of said left and right side surfaces, enabling said left and right side surfaces to be so-expanded.

15. The microwave oven liner of claim 14, further comprising:

a rear surface capable of being placed into said microwave oven substantially proximate a rear interior wall of said microwave oven, comprising at least one rear surface pleat adjoining said at least one vertical pleat.

16. The microwave oven liner of claim 1, wherein said top surface, said bottom surface, said left side surface, and said right side surface form a continuous, unitary structure.

17. The microwave oven liner of claim 1, further comprising a turntable spindle aperture.

18. A microwave oven liner, comprising:

a top surface;

a bottom surface;

a left side surface; and a right side surface; wherein:

said top and bottom surfaces are capable of being expanded from a fully collapsed state of predetermined minimum width to a fully expanded state of predetermined maximum width, and to an intermediate expansion state of any chosen width between said minimum width and said maximum width;

said left and right side surfaces are capable of being expanded from a fully collapsed state of predetermined minimum height to a fully expanded state of predetermined maximum height, and to an intermediate expansion state of any chosen height between said minimum height and said maximum height;

said microwave oven liner is capable of being placed into a microwave oven substantially proximate respective top, bottom, left side, and right side interior walls of an interior of said microwave oven; and said microwave oven liner comprises a liner material capable of withstanding microwave bombardment; and said microwave oven liner further comprising:

an upper left quadrant, an upper right quadrant, a lower left quadrant, and a lower right quadrant;

said upper left quadrant comprising upper left quadrant top and left side surfaces;

said upper right quadrant comprising upper right quadrant top and right side surfaces;

said lower left quadrant comprising lower left quadrant bottom and left side surfaces; and said lower right quadrant comprising lower right quadrant bottom and right side surfaces; wherein:

said microwave oven liner top surface comprises said upper left quadrant top surface and said upper right quadrant top surface;

said microwave oven liner bottom surface comprises said lower left quadrant bottom surface and said lower right quadrant bottom surface;

said microwave oven liner left side surface comprises said upper left quadrant left side surface and said lower left quadrant left side surface; and said microwave oven liner right side surface comprises said upper right quadrant right side surface and said lower right quadrant right side surface.

19. The microwave oven liner of claim 18, further comprising:

a rear surface capable of being placed into said microwave oven substantially proximate a rear interior wall of said microwave oven when said top, bottom, left side and right side surfaces are in a given said state of expansion;

said upper left quadrant further comprising an upper left quadrant rear surface;

said upper right quadrant further comprising an upper right quadrant rear surface;

said lower left quadrant further comprising a lower left quadrant rear surface; and said lower right quadrant further comprising a lower right quadrant rear surface; wherein:

said microwave oven liner rear surface comprises said upper left quadrant rear surface, said upper right quadrant rear surface, said lower left quadrant rear surface, and said lower right quadrant rear surface.

20. The microwave oven liner of claim 19, further comprising:

a height extender strip comprising height extender strip rear, left side, and right side surfaces; wherein said microwave oven liner left side surface further comprises said height extender strip left side surface;

said microwave oven liner right side surface further comprises said height extender strip right side surface; and said microwave oven liner rear surface further comprises said height extender strip rear surface.

21. The microwave oven liner of claim 19, further comprising:

a left half microwave oven liner comprising said upper left quadrant and said lower left quadrant; and a right half microwave oven liner comprising said upper right quadrant and said lower right quadrant;

said left half microwave oven liner further comprising an expandable left half vertical pleating structure adjoining said upper left quadrant and said lower left quadrant in a continuous, unitary structure; and said right half microwave oven liner further comprising an expandable right half vertical pleating structure adjoining said upper right quadrant and said lower right quadrant in a continuous, unitary structure.

22. The microwave oven liner of claim 21:

said left half microwave oven liner and said right half microwave oven liner further comprising an expandable horizontal pleating structure adjoining said left half microwave oven liner and said right half microwave oven liner in a continuous, unitary structure.

23. The microwave oven liner of claim 22, said left and right half vertical pleating structures comprising a single vertical pleat; and said horizontal pleating structure comprising a single horizontal pleat.

24. The microwave oven liner of claim 22, said left and right half vertical pleating structures comprising a plurality of vertical pleats; and said horizontal pleating structure comprising a plurality of horizontal pleats.

25. The microwave oven liner of claim 21, said left half vertical pleating structure comprising a single left half vertical pleat; and said right half vertical pleating structure comprising a single right half vertical pleat.

26. The microwave oven liner of claim 21, said left half vertical pleating structure comprising a plurality of left half vertical pleats; and said right half vertical pleating structure comprising a plurality of right half vertical pleats.

27. A method for protecting a microwave oven from food spatter, comprising the steps of:

expanding top and bottom surfaces of a microwave oven liner from a fully collapsed state of predetermined minimum width to a fully expanded state of predetermined maximum width, and to an intermediate expansion state of any chosen width between said minimum width and said maximum width;

expanding left and right side surfaces of said microwave oven liner from a fully collapsed state of predetermined minimum height to a fully expanded state of predetermined maximum height, and to an intermediate expansion state of any chosen height between said minimum height and said maximum height;

placing said microwave oven liner into said microwave oven substantially proximate respective top, bottom, left side, and right side interior walls of an interior of said microwave oven;

withstanding microwave bombardment by said microwave oven liner, by using a liner material for said microwave oven liner which is capable of withstanding microwave bombardment; and expanding said left and right side surfaces such that said predetermined maximum height exceeds said predetermined minimum height by a factor of greater than approximately 2 to 1.

28. The method of claim 27, wherein:

said step of expanding said top and bottom surfaces comprises using at least one horizontal pleat of said top and bottom surfaces running from a front of said top and bottom surfaces to a rear of said top and bottom surfaces; and said step of expanding said left and right side surfaces comprises using at least one vertical pleat of said left and right side surfaces running from a front of said left and right side surfaces to a rear of said left and right side surfaces.

29. The method of claim 28, comprising the further steps of:

when said microwave oven liner is in said fully collapsed state, forming a pyramid surface comprising a rear surface of said microwave oven liner, with a pleat gathering point of said rear surface proximate an apex of said pyramid surface;

when said microwave oven liner is in said fully expanded state, substantially flattening said rear surface; and placing said rear surface into said microwave oven substantially proximate a rear interior wall of said microwave oven, said rear surface comprising at least one rear surface pleat running from said rear of said top, bottom, left, and right side surfaces to said pleat gathering point.

30. The method of claim 27, comprising the further step of:

placing a rear surface liner sheet separate from said top, bottom, left side, and right side surfaces, into said microwave oven substantially proximate a rear interior wall of said microwave oven.

31. The method of claim 27, comprising the further step of:

placing a front door liner sheet separate from said top, bottom, left side, and right side surfaces, into said microwave oven substantially proximate a front door of said microwave oven.

32. The method of claim 27, comprising the further steps of:

reducing said top, bottom, left side and right surfaces from a predetermined maximum depth to a predetermined minimum depth, and alternatively, to an intermediate state of any chosen depth between said maximum depth and said minimum depth.

33. The method of claim 32, wherein said step of reducing said depths of said top, bottom, left side and right surfaces comprises using a plurality of depth adjustment lines running from left sides of said top and bottom surfaces to right sides of said top and bottom surfaces, and from tops of said left and right side surfaces to bottoms of said left and right side surfaces.

34. The method of claim 27, comprising the further step of:

securing said microwave oven liner to at least one location upon said microwave oven interior using liner-to-oven securing means.

35. The method of claim 27, comprising the further step of fabricating said microwave oven liner from a liner material:

possessing sufficient structural rigidity to freely stand within said microwave oven without any additional independent support structure;

maintaining said structural rigidity throughout repeated microwave bombardment and heating; and substantially not absorbing food spatter.

36. The method of claim 27, comprising the further step of fabricating said microwave oven liner from a liner material selected from the polymer group consisting of:

high-density polyethylene; high-density polypropylene; high density polystyrene; polycarbonates; polyethylene; polypropylene; polystyrene; and blends comprising more than one of high-density polyethylene; high-density polypropylene; high-density polystyrene; polycarbonates; polyethylene; polypropylene; and polystyrene.

37. The method of claim 27, comprising the further step of:

enabling light to pass through at least one transparent region of said microwave oven liner.

38. The method of claim 27, comprising the further step of:

enabling air to pass through at least one venting region of said microwave oven liner.

39. The method of claim 27, comprising the further steps of:

when said top, bottom, left side and right side surfaces are in a given said state of expansion, placing a rear surface of said microwave oven liner into said microwave oven substantially proximate a rear interior wall of said microwave oven.

40. The method of claim 27, wherein:

said step of expanding said left and right side surfaces comprises using at least one vertical pleat of said left and right side surfaces running from a front of said left and right side surfaces to a rear of said left and right side surfaces.

41. The method of claim 40, comprising the further step of:

placing a rear surface of said microwave oven liner into said microwave oven substantially proximate a rear interior wall of said microwave oven, said microwave oven liner comprising at least one rear surface pleat adjoining said at least one vertical pleat.

42. The method of claim 27:

said top surface, said bottom surface, said left side surface, and said right side surface forming a continuous, unitary structure.

43. The method of claim 27, said microwave oven liner further comprising a turntable spindle aperture.

44. A method for protecting a microwave oven from food spatter, comprising the steps of:

expanding top and bottom surfaces of a microwave oven liner from a fully collapsed state of predetermined minimum width to a fully expanded state of predetermined maximum width, and to an intermediate expansion state of any chosen width between said minimum width and said maximum width; and expanding left and right side surfaces of said microwave oven liner from a fully collapsed state of predetermined minimum height to a fully expanded state of predetermined maximum height, and to an intermediate expansion state of any chosen height between said minimum height and said maximum height;

placing said microwave oven liner into said microwave oven substantially proximate respective top, bottom, left side, and right side interior walls of an interior of said microwave oven; and withstanding microwave bombardment by said microwave oven liner, by using a liner material for said microwave oven liner which is capable of withstanding microwave bombardment:

said step of expanding said microwave oven liner top surface comprising adjusting a top overlap region between a top surface of an upper left quadrant of said microwave oven liner and a top surface of an upper right quadrant of said of said microwave oven liner;

said step of expanding said microwave oven liner bottom surface comprising adjusting a bottom overlap region between a bottom surface of a lower left quadrant of said microwave oven liner and a bottom surface of a lower right quadrant of said of said microwave oven liner;

said step of expanding said microwave oven liner left side surface comprising adjusting a left side overlap region between a left side surface of said upper left quadrant of said microwave oven liner and a left side surface of said lower left quadrant of said of said microwave oven liner; and said step of expanding said microwave oven liner right side surface comprising adjusting a right side overlap region between a right side surface of said upper right quadrant of said microwave oven liner and a right side surface of said lower right quadrant of said of said microwave oven liner.

45. The method of claim 44, comprising the further steps of:

when said top, bottom, left side and right side surfaces are in a given said state of expansion, placing a rear surface of said microwave oven liner into said microwave oven substantially proximate a rear interior wall of said microwave oven; and expanding said microwave oven liner rear surface by adjusting a rear overlap region among rear surfaces of each of said upper left, upper right, lower left, and lower right quadrant.

46. The method of claim 45:

said step of expanding said microwave oven liner left side surface further comprising providing a left side surface of a height extender strip between said left side surface of said upper left quadrant and said left side surface of said lower left quadrant when said adjusting said left side overlap region between said left side surface of said upper left quadrant and said left side surface of said lower left quadrant eliminates said left side overlap region;

said step of expanding said microwave oven liner right side surface further comprising providing a right side surface of said height extender strip between said right side surface of said upper right quadrant and said right side surface of said lower right quadrant when said adjusting said right side overlap region between said right side surface of said upper right quadrant and said right side surface of said lower right quadrant eliminates said right side overlap region; and said step of expanding said microwave oven liner rear surface further comprising providing a rear surface of said height extender strip between said rear surfaces of said upper left and upper right quadrants and said rear surfaces of said lower left and lower right quadrants when said adjusting said rear overlap region between said rear surfaces of said upper left and upper right quadrants and said rear surfaces of said lower left and lower right quadrants eliminates said rear overlap region.

47. The method of claim 45:

said step of expanding said microwave oven liner left side surface further comprising expanding a left half vertical pleating structure adjoining said upper left quadrant and said lower left quadrant in a continuous, unitary structure as a left half microwave oven liner; and said step of expanding said microwave oven liner right side surface further comprising expanding a right half vertical pleating structure adjoining said upper right quadrant and said lower right quadrant in a continuous, unitary structure as a right half microwave oven liner.

48. The method of claim 47:

said steps of expanding said microwave oven liner top and bottom surfaces further comprising expanding a horizontal pleating structure adjoining said left half microwave oven liner and said right half microwave oven liner in a continuous, unitary structure.

49. The method of claim 48, said left and right half vertical pleating structures comprising a single vertical pleat; and said horizontal pleating structure comprising a single horizontal pleat.

50. The method of claim 48, said left and right half vertical pleating structures comprising a plurality of vertical pleats; and said horizontal pleating structure comprising a plurality of horizontal pleats.

51. The method of claim 47, said left half vertical pleating structure comprising a single left half vertical pleat; and said right half vertical pleating structure comprising a single right half vertical pleat.

52. The method of claim 47, said left half vertical pleating structure comprising a plurality of left half vertical pleats; and said right half vertical pleating structure comprising a plurality of right half vertical pleats.

* * * * *